US007805904B2

(12) United States Patent
Clark et al.

(10) Patent No.: US 7,805,904 B2
(45) Date of Patent: Oct. 5, 2010

(54) CEILING GRID SPANNER

(75) Inventors: Jeremy A. Clark, Minneapolis, MN (US); Michael A. Whittier, Minneapolis, MN (US); David H. Cheney, Shoreview, MN (US)

(73) Assignee: Target Brands, Inc., Minneapolis, MN (US)

( * ) Notice: Subject to any disclaimer, the term of this patent is extended or adjusted under 35 U.S.C. 154(b) by 58 days.

(21) Appl. No.: 12/016,102

(22) Filed: Jan. 17, 2008

(65) Prior Publication Data

US 2009/0184226 A1 Jul. 23, 2009

(51) Int. Cl.
*E04B 1/38* (2006.01)
*G09F 7/18* (2006.01)

(52) U.S. Cl. ..... 52/506.06; 52/506.07; 52/710; 52/39; 248/317

(58) Field of Classification Search ..... 52/506.06, 52/506.07, 506.08, 710, 712, 39; 248/317, 248/339, 340, 328, 342, 343, 344
See application file for complete search history.

(56) References Cited

U.S. PATENT DOCUMENTS 2,787,435 A * 4/1957 Shields ..... 248/307
2,917,263 A * 12/1959 Appleton et al. ..... 248/217.3
2,926,237 A * 2/1960 Sorenson ..... 362/150
3,021,958 A 2/1962 Winkler
3,104,087 A * 9/1963 Budnick et al. ..... 248/343
3,153,304 A * 10/1964 Evangelista ..... 52/144
3,163,386 A * 12/1964 Collins ..... 248/71
3,374,596 A * 3/1968 O'Brien et al. ..... 52/664
3,561,718 A * 2/1971 Iverson ..... 248/544
3,597,889 A * 8/1971 Lo Nigro ..... 52/28
3,618,176 A * 11/1971 Barnes ..... 248/227.4
4,073,458 A 2/1978 Sease
4,108,315 A * 8/1978 Inao ..... 211/124
4,118,000 A * 10/1978 Campbell ..... 248/227.4
4,122,762 A * 10/1978 Williams ..... 454/292
4,149,693 A * 4/1979 LoNigro ..... 248/342
4,223,488 A * 9/1980 Schoenung ..... 52/39
4,315,611 A 2/1982 Hoop
4,318,525 A * 3/1982 Welch ..... 248/228.7
4,564,165 A * 1/1986 Grant et al. ..... 248/343
4,971,279 A 11/1990 George (Continued)

FOREIGN PATENT DOCUMENTS

WO 9303307 2/1993

OTHER PUBLICATIONS

Product information, Fasteners for Retail online catalog, Banner Kits, 2 pp., www.ffr.com, accesssed on Feb. 1, 2008.

(Continued)

*Primary Examiner*—Robert J Canfield
*Assistant Examiner*—Babajide Demuren
(74) *Attorney, Agent, or Firm*—Nixon & Vanderhye P.C.

(57) ABSTRACT

A suspended ceiling fixture for hanging items from a suspended ceiling that is adjustable in multiple degrees of freedom includes a body spanning a distance between adjacent frame members of a suspended ceiling. The fixture also includes brackets for hanging the body from the adjacent frame members. Additionally included is a hanger assembly for hanging an item from the fixture, where the hanger assembly is adjustable along the body of the fixture.

31 Claims, 8 Drawing Sheets

U.S. PATENT DOCUMENTS

| | | | | | |
|---|---|---|---|---|---|
| 5,009,383 | A * | 4/1991 | Chapman | 248/343 |
| 5,022,173 | A * | 6/1991 | Pfeiffer | 40/617 |
| 5,381,991 | A * | 1/1995 | Stocker | 248/206.5 |
| 5,409,191 | A * | 4/1995 | Wenmaekers | 248/317 |
| 5,480,116 | A * | 1/1996 | Callas | 248/228.4 |
| 5,516,068 | A * | 5/1996 | Rice | 248/300 |
| 5,618,017 | A * | 4/1997 | De Boer | 248/201 |
| 5,619,263 | A * | 4/1997 | Laughlin et al. | 248/343 |
| 5,619,833 | A * | 4/1997 | Neff | 52/506.07 |
| 5,806,823 | A * | 9/1998 | Callas | 248/320 |
| 5,938,157 | A * | 8/1999 | Reiker | 248/200.1 |
| 5,996,506 | A * | 12/1999 | Woytovich | 108/42 |
| 6,029,414 | A * | 2/2000 | MacLeod | 52/506.07 |
| 6,076,788 | A * | 6/2000 | Akiyama | 248/200.1 |
| 6,119,874 | A | 9/2000 | Anderson | |
| 6,481,676 | B1 * | 11/2002 | Bluestone | 248/217.2 |
| 6,491,270 | B1 | 12/2002 | Pfaller | |
| 6,659,414 | B1 * | 12/2003 | Guilmette | 248/303 |
| 6,761,341 | B2 | 7/2004 | Pfaller | |
| 6,768,071 | B1 * | 7/2004 | Gretz | 200/297 |
| 6,971,210 | B2 * | 12/2005 | Kliegle et al. | 52/506.07 |
| 7,032,680 | B2 * | 4/2006 | MacDonald et al. | 169/43 |
| 2002/0148938 | A1 | 10/2002 | Kump et al. | |
| 2003/0145547 | A1 * | 8/2003 | Kliegle et al. | 52/506.07 |
| 2004/0016184 | A1 * | 1/2004 | Huebsch et al. | 52/144 |
| 2005/0086888 | A1 * | 4/2005 | Moore et al. | 52/506.06 |
| 2006/0005495 | A1 * | 1/2006 | Stessel et al. | 52/506.07 |
| 2006/0260245 | A1 * | 11/2006 | Schoolcraft | 52/506.06 |

OTHER PUBLICATIONS

Product information, Fasteners for Retail online catalog, 7103 Ceiling Grid Loop, 1 pg., www.ffr.com, accessed on Feb. 1, 2008.
Product information, Fasteners for Retail online catalog, Aluminum Ceiling Hook, 1 pg., www.ffr.com, accessed on Feb. 1, 2008.
Product information, Fasteners for Retail online catalog, Ceiling Accessories, 5 pp., www.ffr.com, accessed on Feb. 1, 2008.
Product information, Fasteners for Retail online catalog, Sure-Twist Banner Bar®, 1 pg., www.ffr.com, accessed on Feb. 4, 2008.

* cited by examiner

CEILING GRID SPANNER

BACKGROUND

Suspended ceilings typically include a framework suspended from a building structure and a plurality of ceiling tiles supported by the framework. Often times, it is desirable to hang one or more objects from the suspended ceiling. For example, in a retail environment it can be desirable to hang signage, decorations, or other items from the suspended ceiling to provide merchandising information, make an area more attractive, or to serve a variety of other functions. Some clips, brackets, and other hanging fixtures have been proposed for hanging objects from suspended ceilings, though room for improvement remains.

SUMMARY

Some embodiments relate to a suspended ceiling fixture having multiple degrees of freedom. The fixture includes means for spanning a distance between adjacent frame members of a suspended ceiling. The fixture also includes means for hanging the means for spanning from the adjacent frame members. Means for hanging an item from the fixture is also included, where the means for hanging is adjustable along the means for spanning.

Other embodiments relate to a system including a plurality of frame members defining an open gridwork suspended over a floor, the plurality of frame members including a first frame member and a second frame member extending substantially parallel to the first frame member. The system also includes a plurality of tiles supported by the plurality of frame members. A first tile is supported between the first and second frame members. Also included is a grid spanner having a channel member, a hanger assembly, and two end brackets. In particular, the grid spanner has a first end and a second end and defines a length between the first and second ends and forms an inner track extending lengthwise along the channel member. The hanger assembly is slidably received in the track of the channel member. The end brackets include a first end bracket connected to the first end of the channel member and releasably secured to the first frame member and a second end bracket connected to the second end of the channel member and releasably secured to the second frame member.

Various other embodiments are contemplated and should be understood with reference to the text and drawings that follow.

Figure 1:
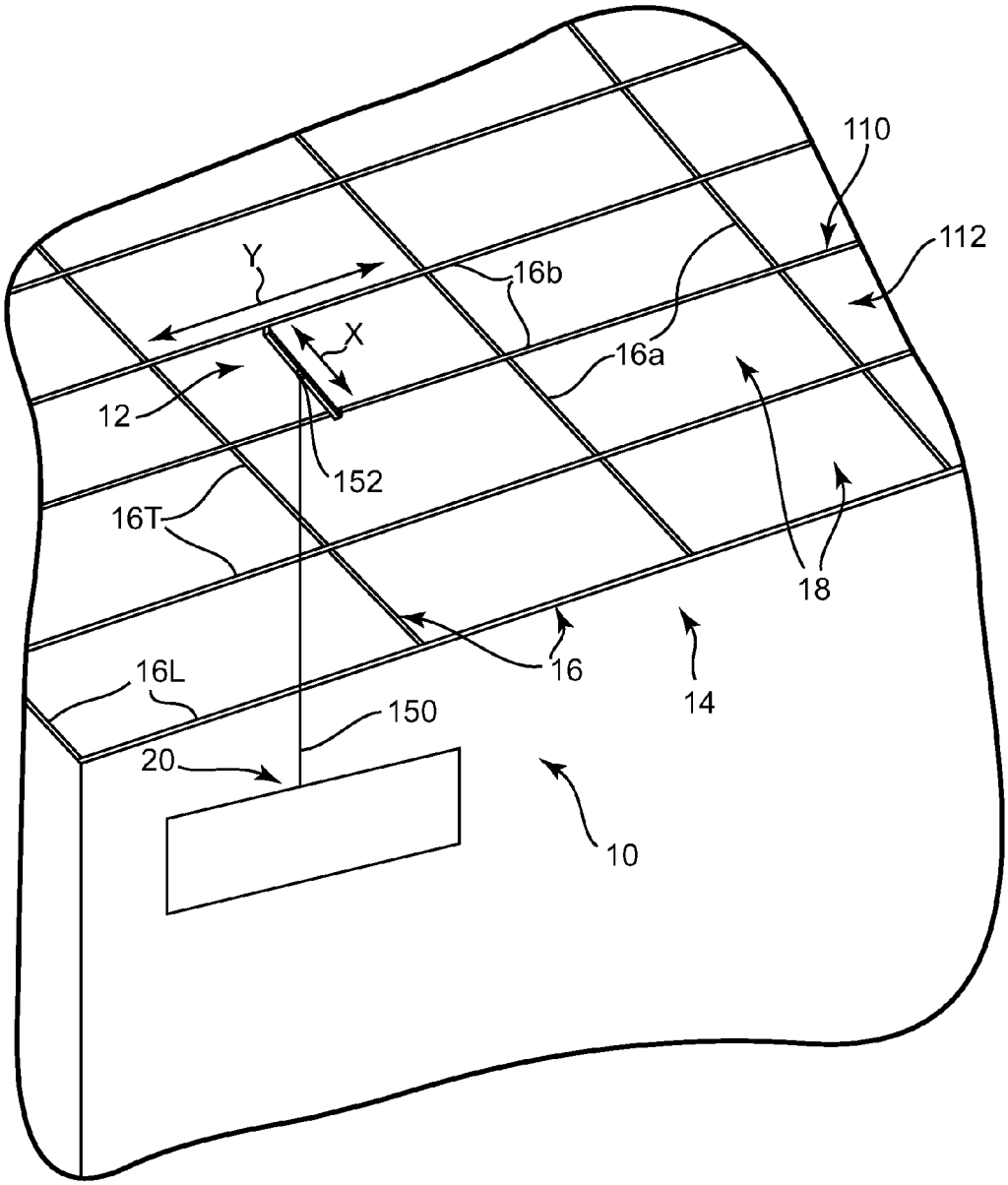
FIG. 1 is a perspective view looking up at a suspended ceiling and associated ceiling grid spanner, according to some embodiments.

While the invention is amenable to various modifications and alternative forms, some embodiments have been shown by way of example in the drawings and are described in detail below. As alluded to above, the intention, however, is not to limit the invention by those examples. On the contrary, the invention is intended to cover all modifications, equivalents, and alternatives.

DETAILED DESCRIPTION

FIG. 1 shows a system 10 including a ceiling grid spanner 12 used with a suspended ceiling assembly 14 of frame members 16 supporting ceiling tiles 18 according to some embodiments. As shown, some of the frame members 16 extend substantially parallel to one another in a longitudinal direction Y and some extend in substantially parallel to one another in a latitudinal direction X. As subsequently described, the ceiling grid spanner 12 is adjustable in at least two degrees of freedom, along both the longitudinal and latitudinal directions Y, X, such that an item 20 can be hung from the suspended ceiling at a desired position. The ceiling grid spanner 12 also optionally provides increased structural stability to the frame members 16 and decreased potential for inadvertent decoupling of the item 20 from the ceiling grid spanner 12. Thus, some embodiment grid spanners provide the ability to hang items from suspended ceilings with increased versatility, safety, reliability, ease of use, and with items having relatively higher weight requirements, for example, though embodiments with additional or alternative features are contemplated.

Figure 2:
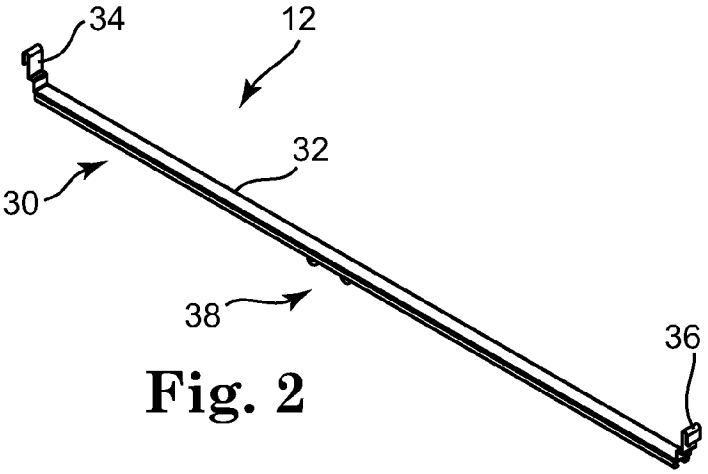
FIG. 2 is an isometric view of the ceiling grid spanner of FIG. 1, according to some embodiments.
Figure 3:
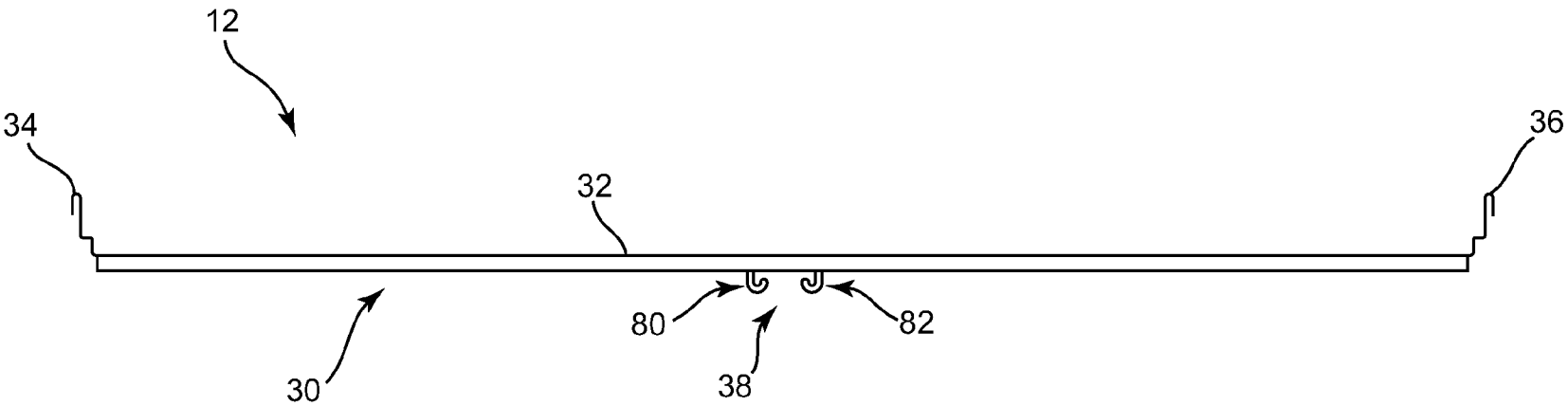
FIG. 3 is a front view of the ceiling grid spanner of FIG. 1, according to some embodiments.

FIGS. 2 and 3 show the ceiling grid spanner 12, also described as a support assembly, from perspective and front views, respectively. As shown, the ceiling grid spanner 12 includes a channel member 30 having a body 32 and first and second end brackets 34, 36, respectively, connected to the body 32, as well as a hanger assembly 38 slidably received in the body 32. Some or all portions of the ceiling grid spanner 12 are formed of metal, such as steel, via metal bending, stamping, welding, or other forming processes, although other materials and manufacturing techniques are contemplated—plastics formed via molding techniques, for example. In some embodiments, the ceiling grid spanner 12 is about 48.5 inches in overall length, although a variety of dimensions are contemplated.

Figure 6:
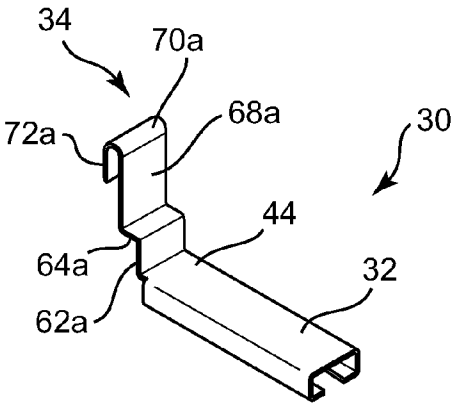
FIG. 6 is an isometric view of the channel member of FIG. 4 with a portion of the channel member removed to facilitate understanding, according to some embodiments.
Figure 7:
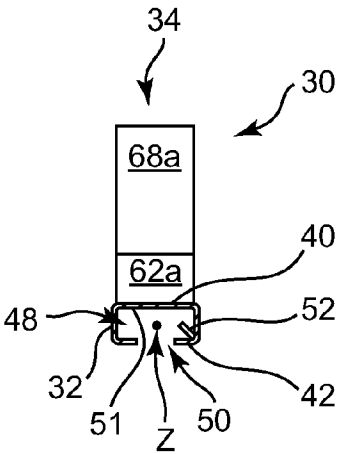
FIG. 7 is a right end view of the channel member with the same portion removed as in FIG. 6, according to some embodiments.
Figure 4:
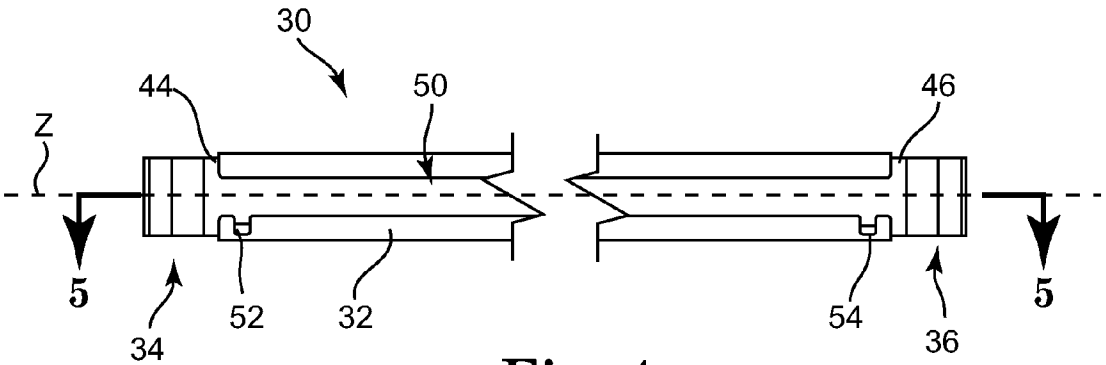
FIG. 4 is a bottom view of a channel member of the ceiling grid spanner of FIG. 1, according to some embodiments.
Figure 5:
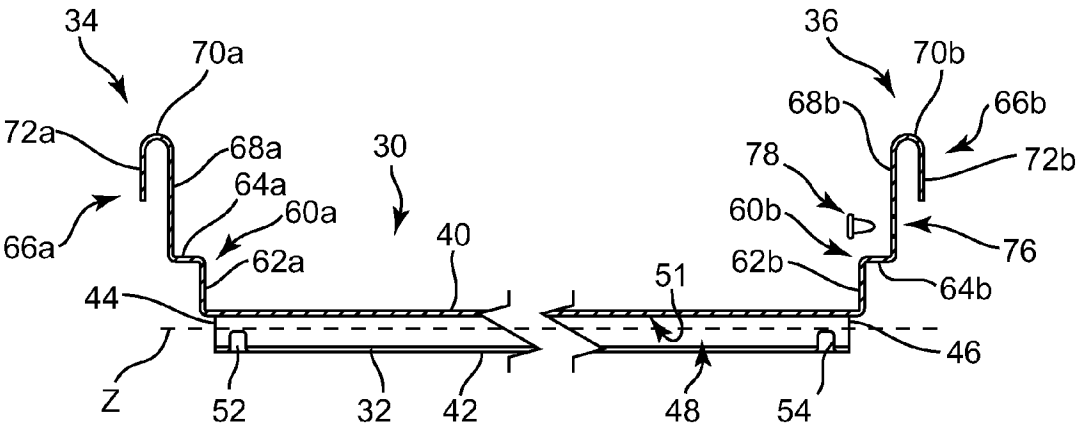
FIG. 5 is a cross-sectional view of the channel member taken along line 5-5 of FIG. 4, according to some embodiments.
Figure 8:
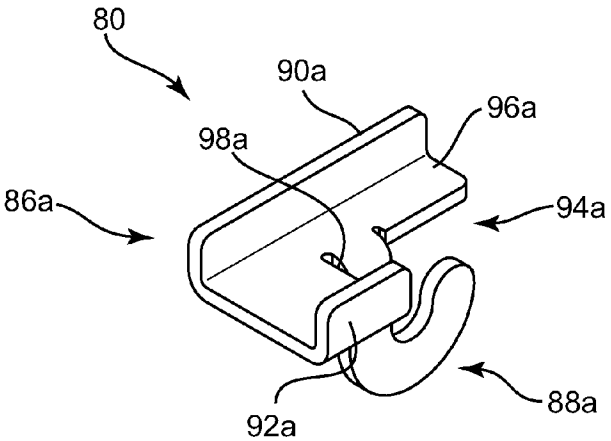
FIG. 8 is an isometric view of a sliding hanger of the ceiling grid spanner of FIG. 1, according to some embodiments.
Figure 9:
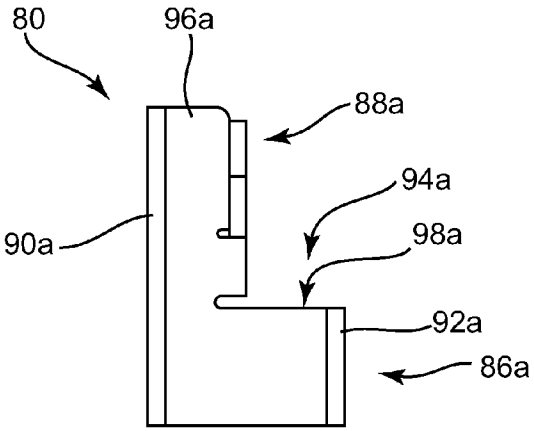
FIG. 9 is a top view of the sliding hanger of FIG. 8, according to some embodiments.
Figure 11:
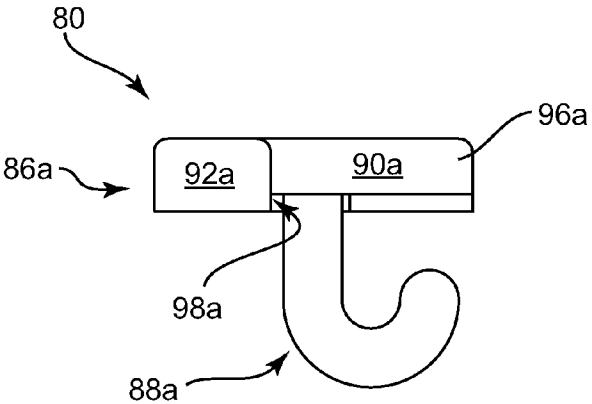
FIG. 11 is a front view of the sliding hanger of FIG. 8, according to some embodiments.

FIGS. 4 and 5 are bottom and cross-sectional views, respectively, of the channel member 30, also described as a cross-member, which provides means for spanning a distance between adjacent frame members 16 (FIG. 1). FIG. 6 is an isometric view of the channel member 30 with a portion of the body 32 cut away for illustration purposes. FIG. 7 is a right end view of the cutaway of FIG. 6. As shown, the body 32, also described as a channel portion, is substantially elongate, defines a central longitudinal axis Z, and has a top 40, a bottom 42, a first end 44, and a second end 46. The body 32 is substantially C-shaped in transverse cross-section, defining an inner track 48, also described as an inner lumen or inner guide, and a mouth 50, also described as a slot, each formed longitudinally along the channel member 30.

The inner track 48 is formed by an interior surface 51 of the body 32. The mouth 50 is formed in the bottom 42 of the body 32. The inner track 48 and the mouth 50 are adapted to slidably receive the hanger assembly 38 (FIG. 2). In some embodiments, the inner track 48 is open ended, although closed ends are also contemplated. The body 32 also includes first and second stops 52, 54 formed toward each of the first and second ends 44, 46, respectively. Each of the stops 52, 54 is formed as a bent tab of material and is adapted to prevent inadvertent ejection of the hanger assembly 38 from the inner track 48. In some embodiments, each of the stops 52, 54 is bent to about a 45 degree angle such that the stops 52, 54 extend inwardly and generally in a direction of the central longitudinal axis Z of the body 32.

The first and second end brackets 34, 36, provide means for hanging the body 32 from the frame members 16 and can also be described as brace portions. The first and second end brackets 34, 36 are optionally substantially similar to one another and thus can be described cumulatively with reference to the first end bracket 34, although a variety of end brackets are contemplated. Features of the first end bracket 34 are designated with a reference number and an "a" while corresponding features of the second end bracket 36 are designated with the same reference number as the first end bracket 34 and a "b."

As shown in FIG. 5, the first end bracket 34 includes a stepped portion 60*a* having a riser 62*a* and a tread 64*a* and a hook portion 66*a* having a body 68*a*, an arcuate top 70*a*, and a retaining lip 72*a*. In some embodiments, the second end bracket 36 further includes a set hole 76, which is adapted to receive a fastener 78, such as a set screw or plastic clip fastener, such as those sold under the trade name "CANOE CLIPS." In some embodiments, the first end bracket 34 additionally or alternatively includes similar holes or other features (not shown).

As shown in FIG. 3, the hanger assembly 38 provides means for hanging an item and includes a first sliding hanger 80 and a second sliding hanger 82, also described as hook members. As previously referenced, each of the hangers 80, 82 is optionally formed of metal material such as steel via metal bending, stamping, or other forming processes, although a variety of materials and associated manufacturing techniques are contemplated. The first and second sliding hangers 80, 82 are optionally formed of a sheet of metal or other material. The features of the first and second sliding hangers 80, 82 are optionally substantially similar and thus are described cumulatively with respect to the first sliding hanger 80, although a variety of sliding hangers are contemplated. Features of the first sliding hanger 80 are designated with a reference number and an "a" while corresponding features of the second sliding hanger 82 are designated with the same reference number and a "b."

FIGS. 8-11 are isometric, top, left-end, and front views, respectively, of the first sliding hanger 80. The first sliding hanger 80 and the second sliding hanger 82 (FIG. 3) each include a base portion 86, also described as a rider portion, and a clasp portion 88. As shown, the base portion 86*a* of the first sliding hanger 80 optionally includes rounded, flared edges 90*a*, 92*a* that help the base portion 86*a* slide within the inner track 48 (FIG. 5) without binding. The base portion 86*a* also has a recess 94*a*, also described as a seat, such that the base portion 86*a* defines a finger 96*a*, also described as a key, of material that protrudes outwardly relative to a leading edge 98*a* of a remainder of the base portion 86*a*. As will be described in greater detail below, the recess 94*a* is adapted or otherwise sized and shaped to receive a finger 96*b* (FIG. 13) of the second sliding hanger 82 in a substantially complementary fit.

Figure 10:
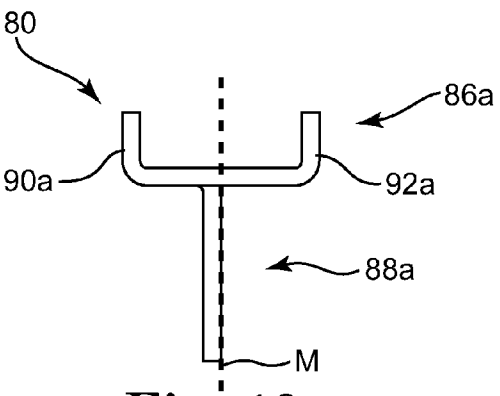
FIG. 10 is a left-end view of the sliding hanger of FIG. 8, according to some embodiments.
Figure 12:
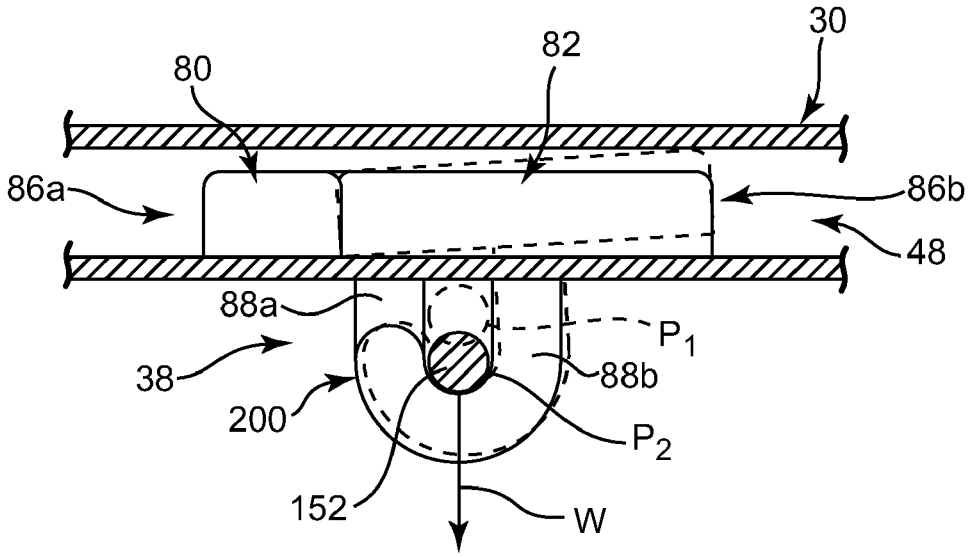
FIG. 12 is a cross-sectional view showing the ceiling grid spanner in a clasped state and supporting an item, according to some embodiments.
Figure 13:
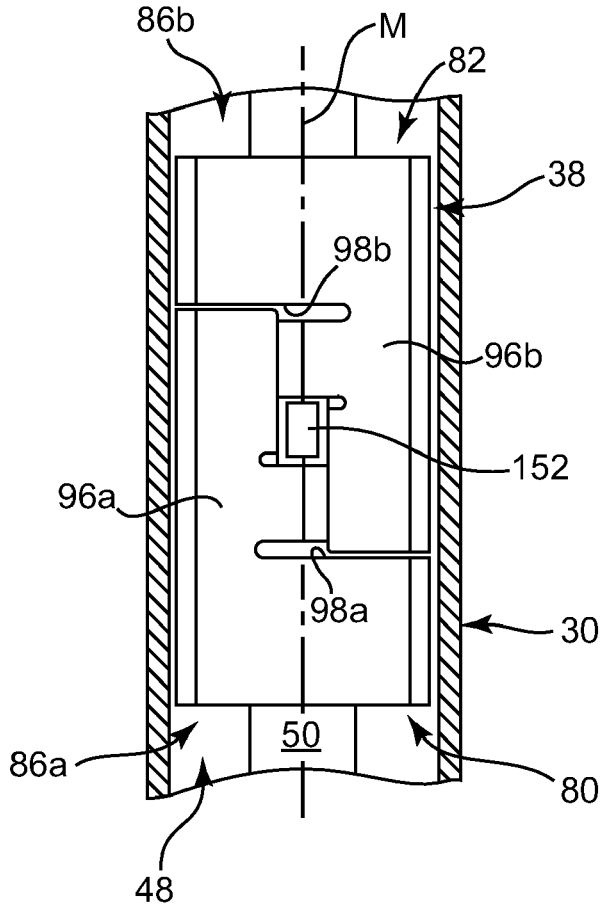
FIG. 13 is another cross-sectional view showing the ceiling grid spanner in a clasped state and supporting an item, according to some embodiments.

In some embodiments, the clasp portion 88*a* extends downward and substantially orthogonally away from the finger 96*a*. As shown, the clasp portion 88*a* is substantially J-shaped and is adapted to support an object to be hung from the ceiling grid spanner 12. As shown in FIG. 10, the clasp portion 88*a* is substantially thin and somewhat offset from a latitudinal centerline M of the base portion 86*a* (FIG. 10). As shown in FIGS. 12 and 13, this offset, along with a corresponding offset of a clasp portion 88*b* of the second sliding hanger 80 results in the two clasp portions 88*a*, 88*b* being substantially centered along the lateral midline of the combined assembly of the first and second sliding hangers 80, 82, which is subsequently described.

FIGS. 12 and 13 are cross-sectional views of the hanger assembly 38 as assembled to the channel member 30. As shown, the base portions 86*a*, 86*b* of the respective sliding hangers 80, 82 are slidably received in the inner track 48 of the channel member 30 with the clasp portions 88*a*, 88*b* extending down through the mouth 50. The sliding hangers 80, 82 are thus able to be slid along the central longitudinal axis Z (FIG. 5) of the body 32 toward and away from one another between an unclasped position (FIGS. 2 and 3) and a clasped position (FIGS. 12 and 13). Movement of the sliding hangers 80, 82 within the body 32 is optionally substantially arrested at the stops 52, 54 (FIG. 5), respectively with the stops 52, 54 acting as travel limits that help prevent inadvertent ejection of the sliding hangers 80, 82 from the body 32.

As shown in FIG. 1, the suspended ceiling assembly 14, also described as a suspension ceiling, hanging ceiling, or false ceiling, is optionally of a type commonly used in stores, homes, or other building structures. As previously referenced, the assembly 14 includes frame members 16, or grid members, and ceiling tiles 18. The frame members 16 form a framework 110, or gridwork, defining a plurality of openings 112, with the ceiling tiles 18 being supported in the openings 112 between adjacent frame members 16. The frame members 16 include latitudinal frame members 16*a* and a plurality of longitudinal frame members 16*b*, where the latitudinal frame members 16*a* are optionally substantially shorter than the longitudinal frame members 16*b* such that the openings 112 are substantially rectangular in shape, although a variety of shapes are contemplated (square, for example). In some embodiments, the latitudinal frame members 16*a* are secured to adjacent ones of the longitudinal frame members 16*b*. However, the latitudinal frame members 16*a* at the perimeter of the assembly 14 are often substantially continuous or are secured end-to-end where needed to span the ceiling space in which the assembly 14 resides. In turn, the longitudinal frame members 16*b* are substantially continuous and are connected end-to-end where insufficiently long to span the entire ceiling space in which the assembly 14 resides.

The frame members 16 that are toward the interior of the assembly 14 are optionally T-shaped frame members 16T and the frame members 16 about the perimeter of the assembly 14 are optionally L-shaped frame members 16L. In particular, the T-shaped frame members 16T have an inverted T-shape in transverse cross-section. In turn, the L-shaped members have a substantially L-shaped transverse cross-section as shown in FIGS. 14 and 15 and described in greater detail below.

The ceiling tiles 18 (FIG. 1) are optionally of a known type, for example being comprised of fiber materials, polymeric materials, pressed materials, and combinations thereof, for example, although any of a variety of ceiling tile materials are optionally selected as appropriate to a particular application. In some embodiments, the ceiling tiles 18 are substantially rectangular, being about 24 inches (about 610 mm) by about 48 inches (about 1,220 mm) and about 0.75 inches (about 19 mm) thick, although a variety of sizes and shapes are contemplated.

Figure 14:
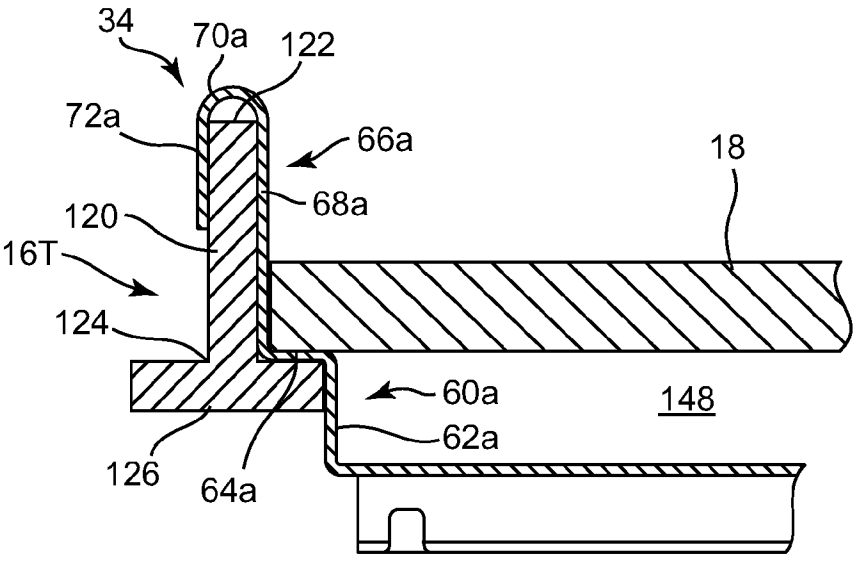
FIG. 14 is a cross-sectional view showing the ceiling grid spanner of FIG. 1 assembled to a portion of the suspended ceiling, according to some embodiments.

FIG. 14 shows a cross-section of the ceiling grid spanner 12 secured to the suspended ceiling assembly 14 (FIG. 1). In particular, FIG. 14 shows a portion of the ceiling grid spanner 12, a transverse cross-section of a portion of one of the T-shaped frame members 16T, and a portion of one of the ceiling tiles 18. The T-shaped frame member 16T includes a web portion 120 having a top 122 and a bottom 124 and a flange portion 126. The flange portion 126 is positioned at the bottom 124 of the web portion 120 and extends substantially orthogonally relative to the web portion 120 in two directions.

Figure 15:
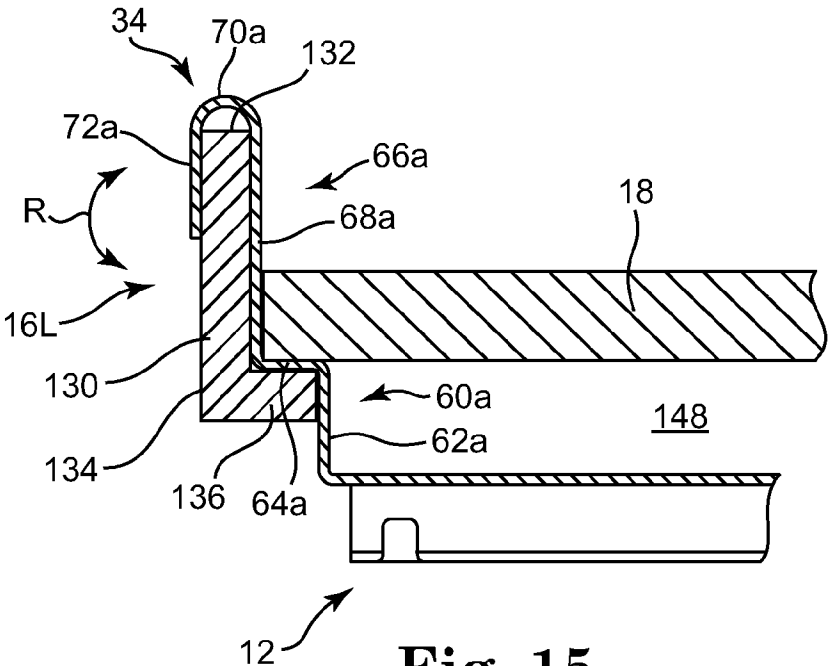
FIG. 15 is a cross-sectional view showing the ceiling grid spanner of FIG. 1 assembled to another portion of the suspended ceiling, according to some embodiments.
Figure 16:
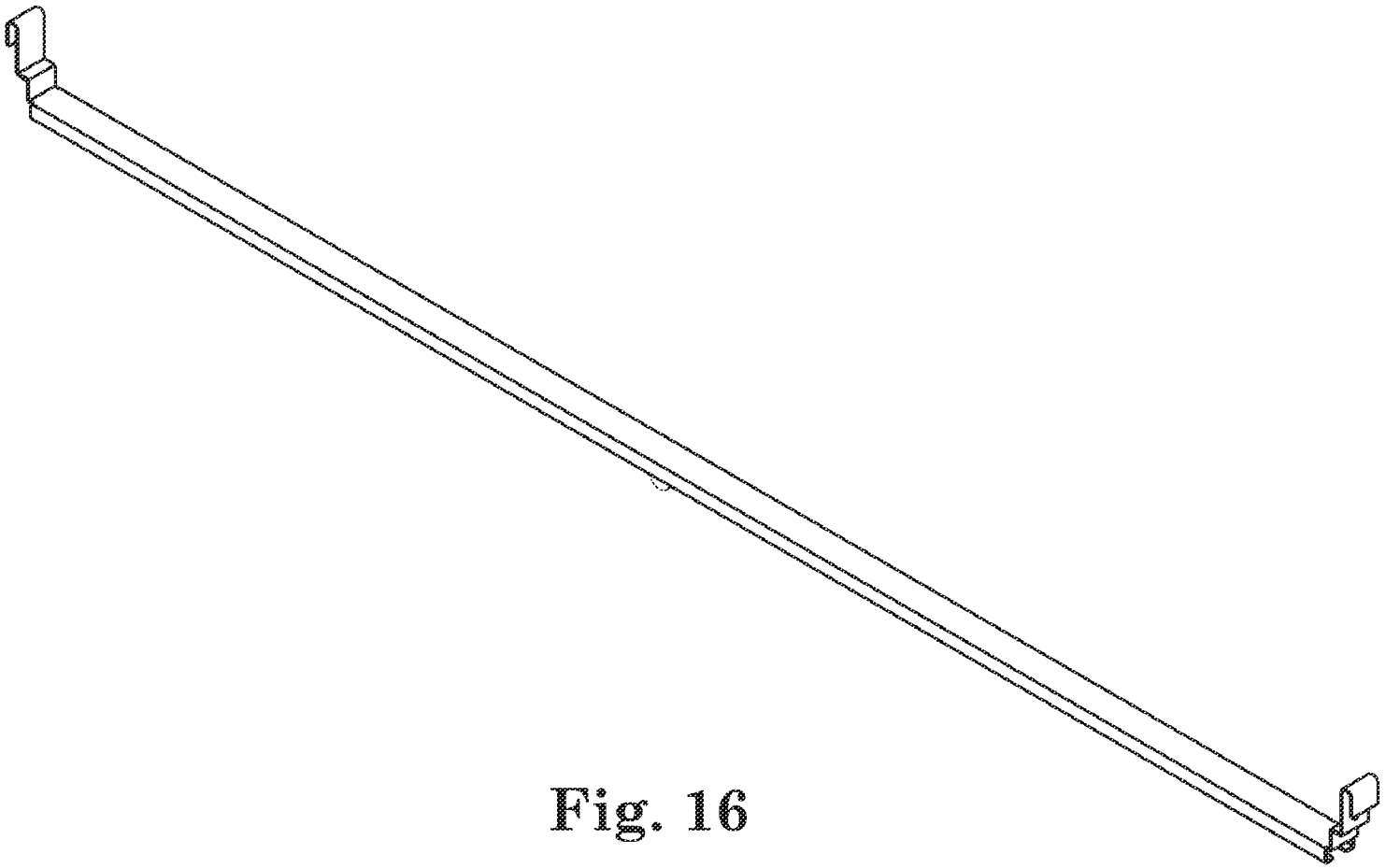
FIGS. 16-20 show the ornamentality of various features of a ceiling grid spanner, according to some embodiments, from perspective, front, top, bottom, and right-end views, respectively, where a left-end view is a mirror image of the right-end view.
Figure 17:
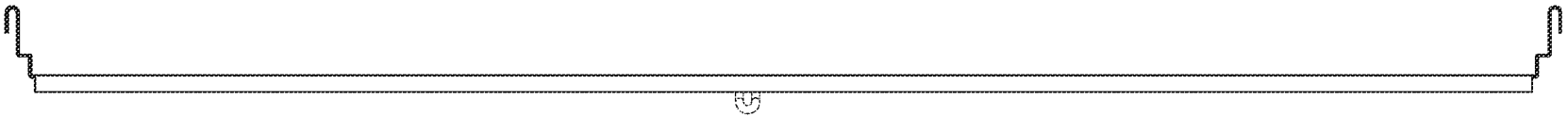
Figure 18:
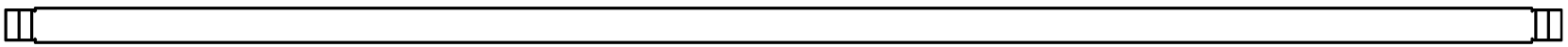
Figure 19:
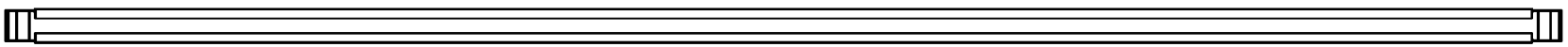
Figure 20:
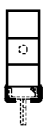

FIG. 15 shows a cross-section of the ceiling grid spanner 12 secured to another portion of the suspended ceiling assembly 14 (FIG. 1). In particular, FIG. 15 shows a portion of the ceiling grid spanner 12, a transverse cross-section of a portion of one of the L-shaped frame members 16L, and a portion of one of the ceiling tiles 18. The L-shaped frame member 16L includes a web portion 130 having a top 132 and a bottom 134 and a flange portion 136. The flange portion 136 is positioned at the bottom 134 of the web portion 130 and extends substantially orthogonally relative to the web portion 130 in a single direction.

Some assemblies and methods of assembling the ceiling grid spanner 12 and the suspended ceiling assembly 14 are described below with reference to FIGS. 1, 14, and 15. As understood with reference to FIG. 1, the ceiling grid spanner 12 is positioned at a desired longitudinal position along the longitudinal direction Y between adjacent frame members 16. In some embodiments, the adjacent frame members 16 are two longitudinal frame members 16*b* (i.e., extending substantially along the longitudinal direction Y) that are also T-shaped frame members 16T (i.e., having a substantially T-shaped transverse cross-section). As alluded to above, various embodiments include mounting the first and second end brackets 34, 36, respectively, to T-shaped and/or L-shaped frame members 16T, 16L as desired, although a variety of differently shaped frame members are also contemplated.

FIGS. 14 and 15 are illustrative of examples of how the first and second brackets 34, 36 are releasably secured to the T-shaped frame members 16T (FIG. 14) or L-shaped frame members 16L (FIG. 15), although the end brackets 34, 36 are optionally adapted to be secured to various types of frame members.

As described in greater detail below some methods of hanging the item 20 from the suspended ceiling assembly 14 include releasably securing the first and second end brackets 34, 36 of the ceiling grid spanner 12 to a laterally adjacent pair of the frame members 16. One of the ceiling tiles 18 is supported between the adjacent frame members 16 such that it extends over the ceiling grid spanner 12. The item 20 is then releasably secured to the hanger assembly 38 (FIG. 12). As shown in FIGS. 12 and 13, in some embodiments, releasably securing the item 20 to the hanger assembly 38 includes bringing the first and second sliding hangers 80, 82 into a complementary fit to lock the item 20 between the first and second sliding hangers 80, 82.

As shown in FIG. 14, assembly of the first end bracket 34 to the T-shaped frame member 16T optionally includes disposing the hook portion 66*a* of the first end bracket 34 over the web portion 120 of the T-shaped frame member 16T. As shown, the arcuate top 70*a* extends over the top 122 of the web portion 120 such that the retaining lip 72*a* and the body 68*a* are opposed to one another about the web portion 120, with the retaining lip 72*a* and body 68*a* extending along the web portion 120 on opposite sides thereof. Additionally, the tread 64*a* of the stepped portion 60*a* optionally rests against or otherwise abuts the flange portion 126 of the T-shaped frame member 16T, providing added stability to the assembly 14. In turn, the riser 62*a* extends downward past the flange portion 126 as desired.

As shown in FIG. 15, assembly of the first end bracket 34 to the L-shaped frame member 16L optionally proceeds similarly, with assembly including disposing the hook portion 66*a* of the first end bracket 34 over the web portion 130 of the L-shaped frame member 16L. The arcuate top 70*a* extends over the top 132 of the web portion 130 such that the retaining lip 72*a* and the body 68*a* are opposed to one another about the web portion 130, with the retaining lip 72*a* and body 68*a* extending along the web portion 130 on opposite sides thereof. Additionally, the tread 64*a* of the stepped portion 60*a* optionally rests against or otherwise abuts the flange portion 136 of the L-shaped frame member 16L, providing added stability to the assembly 14. In turn, the riser 62*a* extends downward past the flange portion 136 as desired.

The first end bracket 34 is positioned along the frame member 16 to which it is assembled in various manners. For example, the ceiling tile 18 supported by the frame member 16 is raised or removed and the first end bracket 34 is seated on the frame member 16 at a desired position. In some embodiments, the first end bracket 34 is placed over the frame member 16 and then slid in the longitudinal direction Y, for example, to the desired position. Assembly of the second end bracket 36 to the adjacent frame member 16 optionally proceeds in a substantially similar manner. Once the ceiling grid spanner 12 is located at its desired position along the adjacent frame members 16, the fastener 78 is optionally inserted into the set hole 76 to assist in retaining the second end bracket 36 and, thus, the ceiling grid spanner 12 at a desired position between the adjacent frame members 16. Although some embodiments include securing the ceiling grid spanner 12 to laterally adjacent frame members 16, in other embodiments the ceiling grid spanner 12 is adapted to allow securing the first and second end brackets to the same frame member 16 or even substantially orthogonal frame members, for example by rotatably securing the first and second end brackets 34, 36 to the body 32 such that the hook portions 66 can be faced toward one another, orthogonally to one another, or at any desired orientation.

In some instances, the frame members 16, and in particular the longitudinal frame members 16L, are susceptible to rotation about their longitudinal axes when the frame members 16 are placed under a load, such as that associated with a hanging item. This rotation can make the frame members 16 less effective in supporting the ceiling tiles 18, less effective in supporting fixtures or other items hanging from the frame members 16, and may even lead to failure. In some embodiments, by securing each of the end brackets 34, 36 to adjacent frame members 16, rotation of the adjacent frame members 16 about their central longitudinal axes is substantially reduced or prevented. In particular, in some embodiments the first and second end brackets 34, 36 resist torquing or forward and backward bending and flexing in direction R (FIG. 15), and by "hooking" the end brackets 34, 36 over the frame members 16, rotation of the frame members 16 is substantially reduced or prevented. In at least this manner, the ceiling grid spanner 12 provides a structurally sound assembly that reinforces the frame members 16 to which it is secured against unwanted rotation or movement.

The ceiling tile 18 is then optionally replaced and rested on the treads 64*a*, 64*b* of the first and second end brackets 34, 36, as well as the surrounding frame members 16. In some embodiments, the sizes of the riser portions 62*a*, 62*b* of the first and second end brackets 34, 36 are selected to result in the body 32 of the channel member 30 extending below the ceiling tile 18 without contacting the ceiling tile 18. In other words, there is optionally a gap 148 between the body 32 and the ceiling tile 18. In other embodiments, the riser portions 62*a*, 62*b* are sized such that the ceiling tile 18 rests on top of the body 32, though a variety of other configurations are also contemplated.

The item 20 is optionally releasably secured to the ceiling grid spanner 12 before or after it is secured to the frame members 16. In some embodiments, the item 20 hangs from an elongate member 150 (FIG. 1) having an end 152 (FIG. 1) adapted to be hung from the hanger assembly 38 (FIGS. 12 and 13). The end 152 optionally includes an eyelet, a hook, a loop of material, a bar, a clasp, or other feature that is able to be hooked onto the hanger assembly 38. For example, in some embodiments, the item 20 is a sign hanging from a wire with a looped end.

The hanger assembly 38 is able to be transitioned between an unclasped position as shown in FIGS. 2 and 3 to a clasped position as shown in FIGS. 12 and 13. As will be described in greater detail, the hanger assembly 38 is optionally adapted to help prevent inadvertent decoupling of the item 20 from the hanger assembly 38 once the hanger assembly 38 has been transitioned to the clasped position. For example, the end 152 of the elongate member 150 is lifted to position P1 and the first and second sliding hangers 80, 82 are brought together to form a complementary fit as shown in FIGS. 12 and 13. Note, the end 152 is shown in cross-section in FIG. 12 and is optionally a wire or metal hook, for example. The item 20 is lowered with the end 152 resting at position P2 being supported by the first and second sliding hangers 80, 82. There is optionally some play between the base portions 86*a*, 86*b* of the sliding hangers 80, 82 and the inner track 48 so that the hangers 80, 82 can be tilted and thereby adjusted to better allow placement of the end 152 between the clasp portions 88*a*, 88*b* if needed. In FIG. 12, a tilted position of the second sliding hanger 82 is shown generally in dotted lines to facilitate understanding.

The complementary fit of the first and second sliding hangers 80, 82 includes the clasp portions 88*a*, 88*b* being juxtaposed next to one another, side-by-side, with their open ends facing toward one another and thus, in opposite directions. In this manner, the two J-shaped clasp portions 88*a*, 88*b* form a substantially closed loop 200 that interferes with the end 152 of the hanging member 150, thereby keeping it releasably secured between the two clasp portions 88*a*, 88*b*. Furthermore, the weight W of the item 20 pulls downwardly and helps prevent inadvertent movement of the clasp portions 88*a*, 88*b* away from one another. For reference, in some embodiments, the ceiling grid spanner 12 is adapted to support relatively heavy items, with the weight W of the item 20 being about 25 lbs or more, for example, although a variety of weights are contemplated.

The sliding hangers 80, 82 are optionally slid in a desired direction along the central longitudinal axis of the body 32 to a desired position with the item 20 hanging from the hanging assembly 38. In this manner, the position of the item 20 along the ceiling grid spanner 12 can be adjusted as desired after the item 20 has been hung from the ceiling grid spanner 12.

As understood in view of the foregoing, various embodiments of the ceiling grid spanner allow items to be hung from the suspended ceiling assembly at a desired longitudinal and latitudinal coordinate position. In other terms, the ceiling grid spanner allows at least two degrees of freedom in hanging an item from a suspended ceiling assembly such that it is positioned as desired relative to a retail floor, for example. Embodiments of the ceiling grid spanner also provide structural reinforcement to suspended ceiling assemblies, allowing heavier items to be supported and/or a more secure support that provides greater reliability and safety.

Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

We claim:

1. A system comprising:

a plurality of frame members defining an open gridwork suspended over a floor, the plurality of frame members including a first frame member and a second frame member extending substantially parallel to the first frame member;

a plurality of tiles supported by the plurality of frame members, including a first tile supported between the first and second frame members; and a grid spanner including:

a channel member having a first end and a second end, defining a length between the first and second ends, and forming an inner track extending lengthwise along the channel member;

a hanger assembly slidably received in the track of the channel member, wherein the hanger assembly includes a first hook member and a second hook member each having a base portion slidably received in the inner track of the channel member and wherein the first hook member and the second hook member are adapted to mate in a complementary fit;

a first end bracket fixedly connected to the first end of the channel member and having a first hook portion that is releasably secured to the first frame member, the first hook portion having a lateral width that is greater than a thickness of the first hook portion; and a second end bracket connected to the second end of the channel member and releasably secured to the second frame member, wherein the first frame member includes a web portion that is substantially vertical and a flange portion that is substantially horizontal, and further wherein the first end bracket includes a hook portion adapted to extend over the web portion, a body portion adapted to extend along the web portion, a tread portion adapted to extend along the flange portion, and a riser portion adapted to extend below the flange portion, the first tile being supported on the tread portion, and the channel member being spaced from the tread portion by the riser portion such that the channel member is disposed below the flange portion.

2. The system of claim 1, wherein the first frame member has a transverse cross-section that is substantially L-shaped.

3. The system of claim 1, wherein the first frame member has a transverse cross-section that has a substantially inverted T-shape.

4. The system of claim 1, wherein each of the first hook member and the second hook member include a hook portion protruding from the channel member.

5. The system of claim 1, wherein the first tile abuts the first and second end brackets.

6. The system of claim 1, further comprising an item to be hung from the grid spanner, the item weighing at least about 25 pounds.

7. The system of claim 1, wherein:

the first end bracket slidably engages the first frame member at a selected longitudinal position; and the second end bracket slidably engages the second frame member at the selected longitudinal position.

8. The system of claim 7, wherein the first end bracket is placed over the first frame member and slidably engages therewith, and wherein the second end bracket is placed over the second frame member and slidably engages therewith.

9. The system of claim 7, wherein the selected longitudinal position is adjustable while the first end bracket is engaged with the first frame member and the second end bracket is engaged with the second frame member.

10. A system comprising:

a plurality of frame members defining an open gridwork suspended over a floor, the plurality of frame members including a first frame member and a second frame member extending substantially parallel to the first frame member;

a plurality of tiles supported by the plurality of frame members, including a first tile supported between the first and second frame members; and a grid spanner including:

a channel member having a first end and a second end, defining a length between the first and second ends, and forming an inner track extending lengthwise along the channel member;

a hanger assembly slidably received in the track of the channel member;

a first end bracket fixedly connected to the first end of the channel member and having a first hook portion that is releasably secured to the first frame member, the first hook portion having a lateral width that is greater than a thickness of the first hook portion; and a second end bracket connected to the second end of the channel member and releasably secured to the second frame member, wherein the first frame member includes a web portion that is substantially vertical and a flange portion that is substantially horizontal, and further wherein the first end bracket includes a hook portion adapted to extend over the web portion, a body portion adapted to extend along the web portion, a tread portion adapted to extend along the flange portion, and a riser portion adapted to extend below the flange portion, the first tile being supported on the tread portion, and the channel member being spaced from the tread portion by the riser portion such that the channel member is disposed below the flange portion.

11. The system of claim 10, wherein the first frame member has a transverse cross-section that is substantially L-shaped.

12. The system of claim 10, wherein the first frame member has a transverse cross-section that has a substantially inverted T-shape.

13. The system of claim 10, wherein the hanger assembly includes a first hook member and a second hook member adapted to mate in a complementary fit.

14. The system of claim 10, wherein the hanger assembly includes first and second hook members each having a base portion slidably received in the inner track of the channel member and each of the base portions of the first hook member and the second hook member include a hook portion protruding from the channel member.

15. The system of claim 10, wherein:

the first end bracket slidably engages the first frame member at a selected longitudinal position; and the second end bracket slidably engages the second frame member at the selected longitudinal position.

16. The system of claim 15, wherein the first end bracket is placed over the first frame member and slidably engages therewith, and wherein the second end bracket is placed over the second frame member and slidably engages therewith.

17. The system of claim 15, wherein the selected longitudinal position is adjustable while the first end bracket is engaged with the first frame member and the second end bracket is engaged with the second frame member.

18. A support assembly for use with laterally adjacent and substantially parallel first and second frame members of a suspended ceiling, the support assembly comprising:

a cross-member including:

a channel portion that is substantially elongate and has a substantially C-shaped transverse cross-section;

a first brace portion adapted to slidably engage the first frame member at a desired longitudinal position, the first brace portion rigidly extending from the channel portion;

a second brace portion adapted to be secured along the second frame member at the desired longitudinal position;

a first sliding hanger received within the channel portion such that it is longitudinally adjustable along the channel portion; and a second sliding hanger received within the channel portion such that it is longitudinally adjustable along the channel portion;

wherein the first sliding hanger includes a first rider portion having a first recess and a first finger and the second sliding hanger includes a second rider portion having a second recess and a second finger, and wherein the first and second sliding hangers are adapted to mate in a complementary fit with the first finger being received in the second recess and the second finger being received in the first recess.

19. The support assembly of claim 18, wherein the first and second sliding hangers each include a rider portion received in the channel portion and a clasp portion protruding from the channel portion.

20. The support assembly of claim 18, wherein the first sliding hanger includes a first clasp portion and the second sliding hanger includes a second clasp portion, and further wherein the complementary fit includes the first and second clasp portions facing in opposite directions and being side-by-side.

21. The support assembly of claim 20, wherein the complementary fit includes the first and second clasp portions forming a substantially closed loop.

22. A system comprising:

a plurality of frame members defining an open gridwork suspended over a floor, the plurality of frame members including a first frame member and a second frame member extending substantially parallel to the first frame member;

a plurality of tiles supported by the plurality of frame members, the plurality of tiles including a first tile supported between the first and second frame members; and a grid spanner slidably mounted to the first and second frame members at a selected longitudinal position, including:

a channel member having a first end and a second end, defining a length between the first and second ends, and forming an inner track extending lengthwise along the channel member;

a first brace portion rigidly extending from the first end and placed over the first frame member to slidably engage therewith;

a second brace portion rigidly extending from the second end and placed over the second frame member to slidably engage therewith; and a hanger assembly slidably received in the track of the channel member so as to slidably adjust to a selected lateral position between the first and second frame members;

wherein the first frame member includes a web portion that is substantially vertical and a flange portion that is substantially horizontal, and further wherein the first brace portion includes a hook portion adapted to extend over the web portion, a body portion adapted to extend along the web portion, a tread portion adapted to extend along the flange portion, and a riser portion adapted to extend below the flange portion, the first tile being supported on the tread portion, and the channel member being spaced from the tread portion by the riser portion such that the channel member is disposed below the flange portion.

23. The system of claim 22 wherein the selected longitudinal position is adjustable while the first brace portion is engaged with the first frame member and the second brace portion is engaged with the second frame member.

24. The system of claim 22 wherein the hanger assembly includes:

a first sliding hanger received within the channel member such that it is slidable along the channel member; and a second sliding hanger received within the channel member such that it is slidable along the channel member; and wherein the second sliding hanger has a shape that is complementary to a shape of the first sliding hanger.

25. A system comprising:

a plurality of frame members defining an open framework ceiling suspended over a floor, the plurality of frame members including a first frame member and a second frame member extending substantially parallel to the first frame member;

a plurality of tiles supported by the plurality of frame members, including a first tile supported between the first and second frame members; and a grid spanner including:

a cross member extending parallel to and beneath the first tile, wherein the cross member has a first end and a second end, defining a length between the first and second ends;

a first end bracket extending from the first end and coupled to the first frame member;

a second end bracket rigidly extending from the second end and coupled to the second frame member; and a first hanger attached to the cross members wherein the first frame member includes a web portion that is substantially vertical and a flange portion that is substantially horizontal, and further wherein the first end bracket includes a hook portion adapted to extend over the web portion, a body portion adapted to extend along the web portion, a tread portion adapted to extend along the flange portion, and a riser portion adapted to extend below the flange portion, the first tile being supported on the tread portion, and the cross member being spaced from the tread portion by the riser portion such that the cross member is disposed below the flange portion.

26. The system of claim 25, wherein the first end bracket slidably engages the first frame member and the second end bracket slidably engages the second frame member.

27. The system of claim 25, wherein the cross member is spaced apart from the first tile.

28. The system of claim 25, wherein the first hanger is adapted to be selectively positioned along the cross member.

29. The system of claim 25, further comprising a second hanger adapted to be selectively positioned along the cross member.

30. The system of claim 25, further comprising display signage coupled to the first hanger.

31. The system of claim 25, wherein the cross member has a substantially C-shaped cross section.

* * * * *